US006570074B1

(12) United States Patent
Rode

(10) Patent No.: US 6,570,074 B1
(45) Date of Patent: May 27, 2003

(54) QUICK RELEASE LATCH ASSEMBLY FOR DRUMHEAD

(76) Inventor: Nodar Rode, 147 Columbus Ave., Closter, NJ (US) 07674

( * ) Notice: Subject to any disclaimer, the term of this patent is extended or adjusted under 35 U.S.C. 154(b) by 0 days.

(21) Appl. No.: 09/971,559

(22) Filed: Oct. 5, 2001

(51) Int. Cl.[7] ..... G10D 13/02
(52) U.S. Cl. ..... 84/413
(58) Field of Search ..... 84/413, 411 A, 84/411 R

(56) References Cited

U.S. PATENT DOCUMENTS

| | | | | | |
|---|---|---|---|---|---|
| 1,442,369 | A | | 1/1923 | Sweet | |
| 3,533,324 | A | | 10/1970 | Price | |
| 4,583,442 | A | * | 4/1986 | Minor | 84/413 |
| 4,693,163 | A | | 9/1987 | Hsieh | |
| 4,694,726 | A | | 9/1987 | Silvestri | |
| 4,804,215 | A | | 2/1989 | Bisbing | |
| 5,952,594 | A | * | 9/1999 | Chuang | 84/413 |
| 6,265,650 | B1 | * | 7/2001 | Arbiter | 84/411 R |
| 6,278,045 | B1 | * | 8/2001 | Reyes | 84/411 R |
| 6,372,972 | B1 | * | 4/2002 | Meinl | 84/411 R |

* cited by examiner

*Primary Examiner*—Kim Lockett
(74) *Attorney, Agent, or Firm*—Natter & Natter

(57) ABSTRACT

A quick release latch assembly for securement of a drumhead utilizes a rim for retaining the drumhead and tension bolts for tuning the drumhead. A keeper member is threaded to an end portion of the bolt. The keeper member includes a locking lug. A bracket member is mounted to the drumshell in alignment with the bolt. The keeper member is guidingly accommodatable within the bracket member. The bracket member includes a pivotal operating lever having an attached locking member. The operating lever is angularly displaceable in a first direction for engaging with the locking lug. A force is generated on the locking lug when the operating lever is displaced in a second direction. The force is transmitted through the keeper member and tension bolt to the drumhead. The magnitude of the resultant force can be modified by changing the relative location of the keeper member along the length of the tension bolt. A component of the force applied to the keeper member is nonaxial with respect to the tension bolt to prevent loosening of the keeper member connection with the tension bolt.

11 Claims, 3 Drawing Sheets

FIG. 1
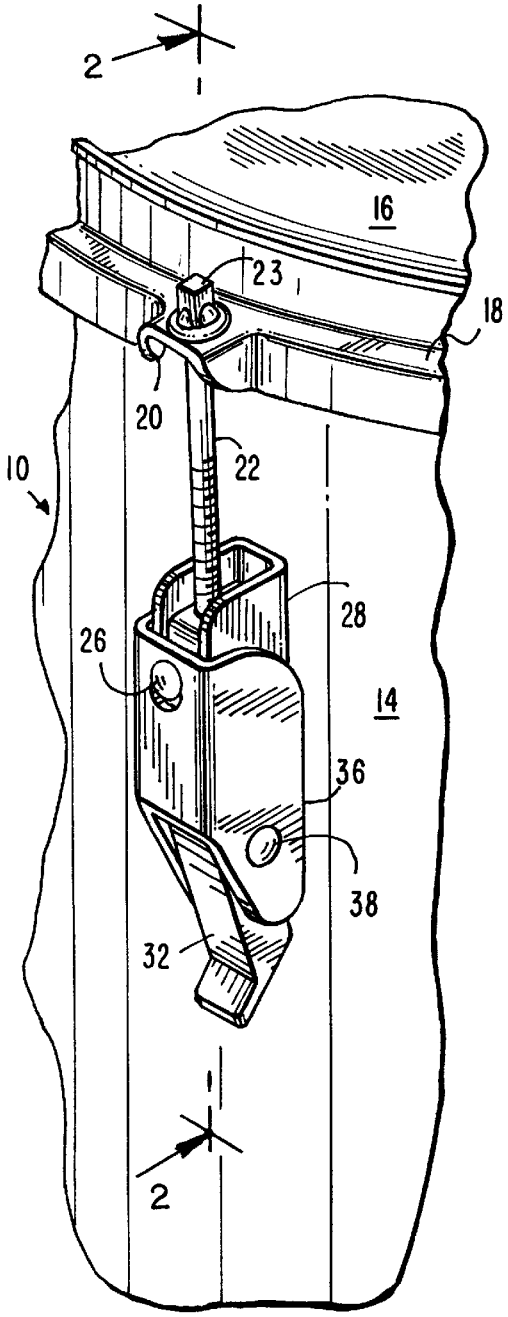
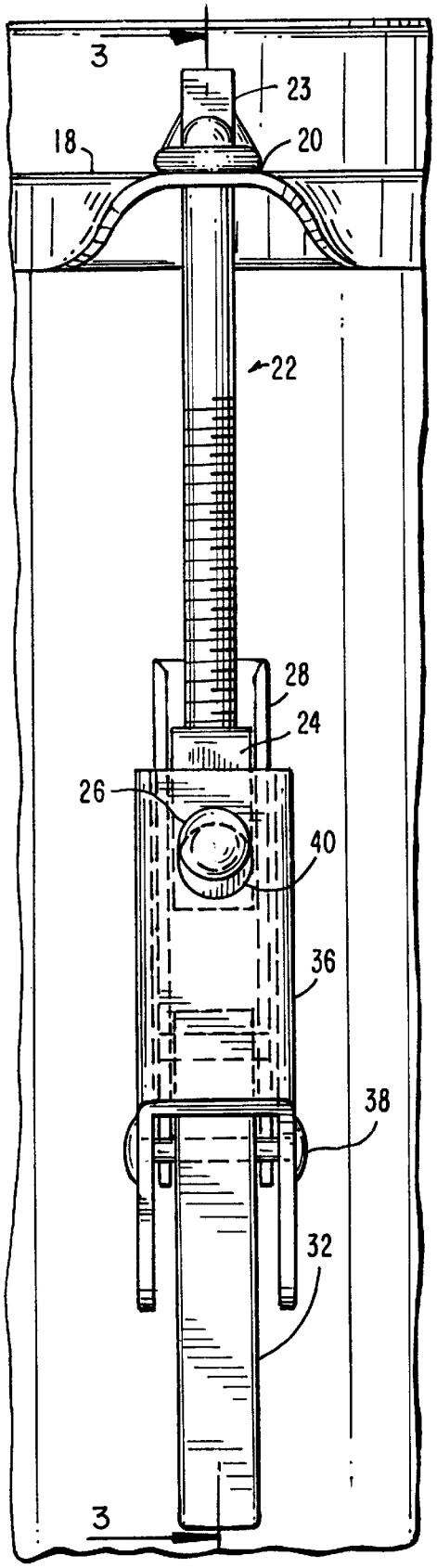
FIG. 2

QUICK RELEASE LATCH ASSEMBLY FOR DRUMHEAD

BACKGROUND OF THE INVENTION

1. Field of the Invention

This invention relates to musical instruments and especially to drums. In particular, the latch assembly of this invention is directed to drumhead securement.

2. Description of the Related Art

By way of background, drums are percussion instruments designed to produce rhythmic sound patterns. A typical drum construction includes a cylindrical drumshell having one or both of its ends covered by a drumskin or drumhead which is held over the ends by a hoop or rim. A plurality of tension bolts, also referred to as tuning rods are placed through apertures in the rim at uniformly spaced intervals along the rim. The tension bolts are threaded into respective tension brackets mounted around the drumshell. The bolt may be tightened with a drum key for threadably engaging the bracket. Preferably each bolt is tightened the same amount to apply a uniform tension to the drumhead until a desired sound and pitch is achieved.

When a drumhead is removed, such as for repair or replacement, each of the bolts must be disengaged from the respective bracket to permit the rim to be lifted off the drumshell thereby releasing the drumhead. A new or replacement drumhead may then be fitted over the end of the drumshell and each of the bolts is reinstalled. This requires a re-tuning of the drumhead. The procedure is time consuming and can be distressful to musicians if the need to replace the drumhead should occur during a performance.

Drummers are also faced with another problem. A typical percussion instrument setup includes several drums of different types and sizes, cymbals, stands for supporting the instruments, and related apparatus. The logistics involved in transporting drum outfits to and from performance venues could be greatly simplified if space-saving consolidation, such as nestable storage of one drum within another, could be practically implemented. However, this would require a readily removable drumhead.

A further deficiency of the previously described threaded drumhead attachment devices is that the drumming vibrations and stress placed upon the drumhead and drumshell during a musical performance tend to create slack in the threaded bracket connection so as to require re-tuning of the drumhead.

Several devices have attempted to overcome some of these shortcomings. For example, the device of U.S. Pat. No. 3,533,324 utilizes a toggle lock having a yolk member that is removably attachable to a bracket affixed to the drumshell. The yolk member remains attached to a tension rod when the rim is removed. This is not a practical solution in that it is cumbersome to reattach the yolk member to the bracket when reinstalling the drumhead. Also, free rotation of the removed yolk member may inadvertently change the tension setting and necessitate re-tuning.

The lug assembly shown in U.S. Pat. No. 4,693,163 relies upon a kidney-shaped slot to provide clearance for the lug assembly to be slipped off a receiver nut to release a tension rod before the drumhead can be released. The tension rod must be partially unthreaded from the receiver nut for removal and consequently the drumhead must be re-tuned.

The drumhead tightening arrangement shown in U.S. Pat. No. 4,694,726 employs a tension bolt threaded to a pin lodged within an elongated plate. The plate remains attached to the bolt when the drumhead is released and unintentional movement of the plate may loosen the threaded connection.

Furthermore, the aforementioned devices do not address the problem of maintaining the integrity of the drumhead tension setting during play.

BRIEF SUMMARY OF THE INVENTION

To briefly summarize, the invention concerns a quick release latch assembly for securement of a drumhead retained over an end of a drumshell by a rim. A plurality of tension bolts are supported from the rim and depend along the drumshell at uniformly spaced intervals. A keeper member is threadably engaged with an end portion of the bolt. The keeper member includes a locking lug. A bracket member is mounted to the drumshell in alignment with the respective bolt. The bracket member includes an operating lever mechanically linked to a locking member. The keeper member is slidably accommodatable within the bracket member. The operating lever is angularly displaceable in a first direction to position the locking member in engagement with the locking lug. A force is generated on the locking lug when the operating lever is displaced in a second direction. The force is transmitted through the keeper member and the tension bolt to the drumhead.

The magnitude of the force can be varied, for adjusting drumhead tension, by changing the relative location of the keeper member along the end portion of the tension bolt. The tension setting remains unchanged when the keeper member is removed from the bracket member. The force applied to the keeper member also prevents the keeper member from unfastening.

A feature of this invention is the ease and swiftness of drumhead removal and reattachment. This can be achieved, with some practice, by touch and without visible inspection. The effectiveness of the procedure makes nestable storage a practical option.

In view of the foregoing, it should be apparent that the present invention overcomes many of the deficiencies of the prior art and provides an improved quick release latch assembly for a drumhead.

Having thus summarized the invention, it will be seen that it is a preferred object thereof to provide an improved quick release latch assembly for a drumhead of the general character described herein which is not subject to the aforementioned shortcomings.

Another preferred object of this invention is to provide a release latch assembly that does not require re-tuning upon drumhead replacement.

A further preferred object of this invention is to provide a release latch assembly that maintains drumhead tension during play.

Still another preferred object of this invention is to provide a release latch assembly that is readily adaptable for retrofitting with a conventional musical drum.

Yet still another preferred object of this invention is to provide a release latch assembly that is practical to use, reliable in operation, attractive in appearance, simple in design and economical to manufacture.

With these ends in view, the invention finds the embodiment in certain combinations of elements and arrangements of parts by which the aforementioned preferred objects and certain other objects are hereinafter attained, or as more fully described with reference to the accompanying drawings and the scope of which is more particularly pointed out and indicated in the appended claims.

BRIEF DESCRIPTION OF THE SEVERAL VIEWS OF THE DRAWINGS

In the accompanying drawings in which is shown an exemplary embodiment of the invention:

FIG. 1 is a perspectival view showing the release latch assembly of this invention on a drum;

FIG. 2 is a front elevational view taken substantially along line 2—2 of FIG. 1 to a slightly enlarged scale, showing the release latch assembly in a locked operative mode;

DETAILED DESCRIPTION OF THE INVENTION

Figure 3:
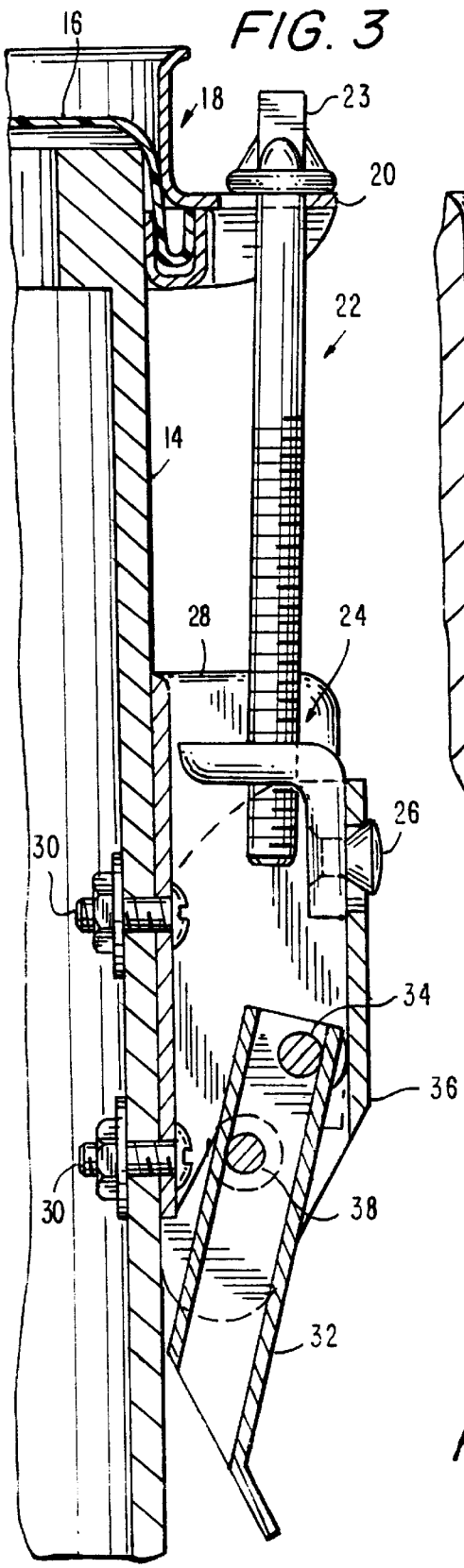
FIG. 3 is a sectional elevational view taken substantially along line 3—3 of FIG. 2 and illustrating the interaction between a bracket member fixedly connected to a drumshell, a locking member engaging a lock lug and an operating lever for transmitting a force to a tension bolt.

With specific reference now to the figures in detail, it is stressed that the particulars shown are by way of example and for the purpose of illustrative discussion of the preferred embodiments of the present invention only and are presented in the cause of providing what is believed to be the most useful and readily understood description of the principles and conceptual aspects of the invention. In this regard, no attempt is made to show structural aspects of the invention in more detail than is necessary for a fundamental understanding of the invention, the description taken with the drawings make it apparent to those skilled in the art how the invention may be embodied in practice.

Referring now in detail to the drawings, the reference numeral 10 denotes generally a release latch assembly for musical drums as encompassed by this invention.

The release latch assembly 10 is shown in FIGS. 1 and 2 as applied to a drum having a cylindrical drumshell 14 and a drumskin or drumhead 16 which is conventionally secured over an open end Of the shell 14 by a retainer rim 18. The rim 18 is provided with uniformly spaced relief tabs 20 for respectively supporting a plurality of tension bolts 22. By way of example, drums denoted as Tom Tom's, range in size from 6" to 18" in diameter and 6 to 8 tension bolts are used to secure the drumhead. Each of the bolts 22 has a head 23 that can be turned by a drum key (not shown) as will be discussed herein; the invention will be described with respect to one of said tension bolts 22.

Figure 4:
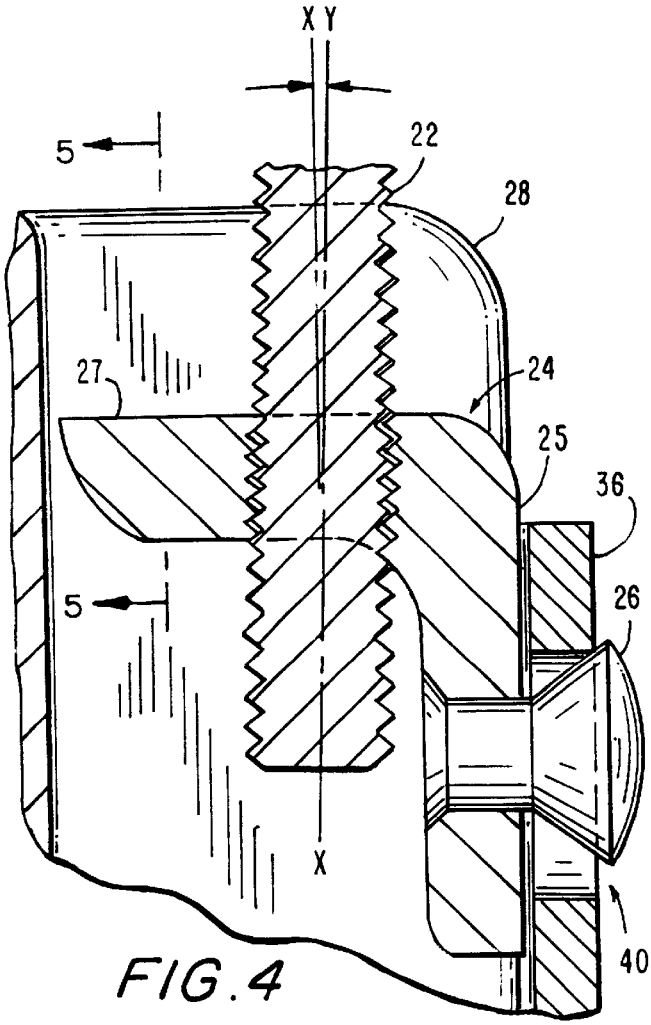
FIG. 4 is a partial view in section to an enlarged scale showing a threaded connection between a tension bolt and a keeper member.

An end portion of the bolt 22 is externally threaded for engaging a keeper member 24. The keeper member 24, as shown in FIGS. 3 and 4, includes a flange segment 25 connected to a spacer segment 27. The bolt 22 is attached through an aperture in spacer segment 27. A locking lug 26, such as a screw head, projects from the flange segment 25 as best shown in FIG. 4. The spacer segment 27 functions to hold and position the bolt 22 to facilitate engagement of the locking lug 26.

Figure 5:
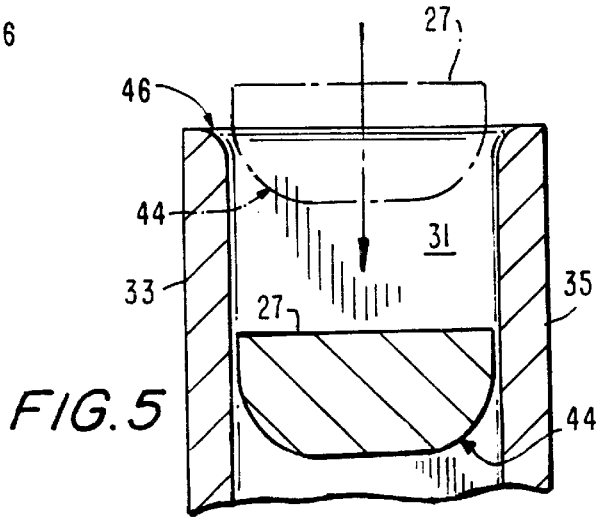
FIG. 5 is a partial view in section, to an enlarged scale, taken substantially along line 5—5 of FIG. 4 for illustrating, by broken line and arrow, the dockable entry of the keeper member into the bracket member.

A bracket member 28 is typically mounted to the drumshell 14 by conventional screw fasteners 30. The bracket member 28 is comprised of a channel member having a backwall 31 mounted contiguous to the drumshell 14 and spaced apart parallel side walls 33, 35 extending outwardly from the backwall 31. The side walls 33, 35 are adapted for slidably accommodating the keeper member 24. In this regard, the confronting surfaces 44, 46 of the respective keeper member 24 and the bracket member 28 are finished with beveled, chambered or rounded edges as shown in FIGS. 4 and 5 to facilitate docking the keeper member 24 within the bracket member 28.

Figure 6:
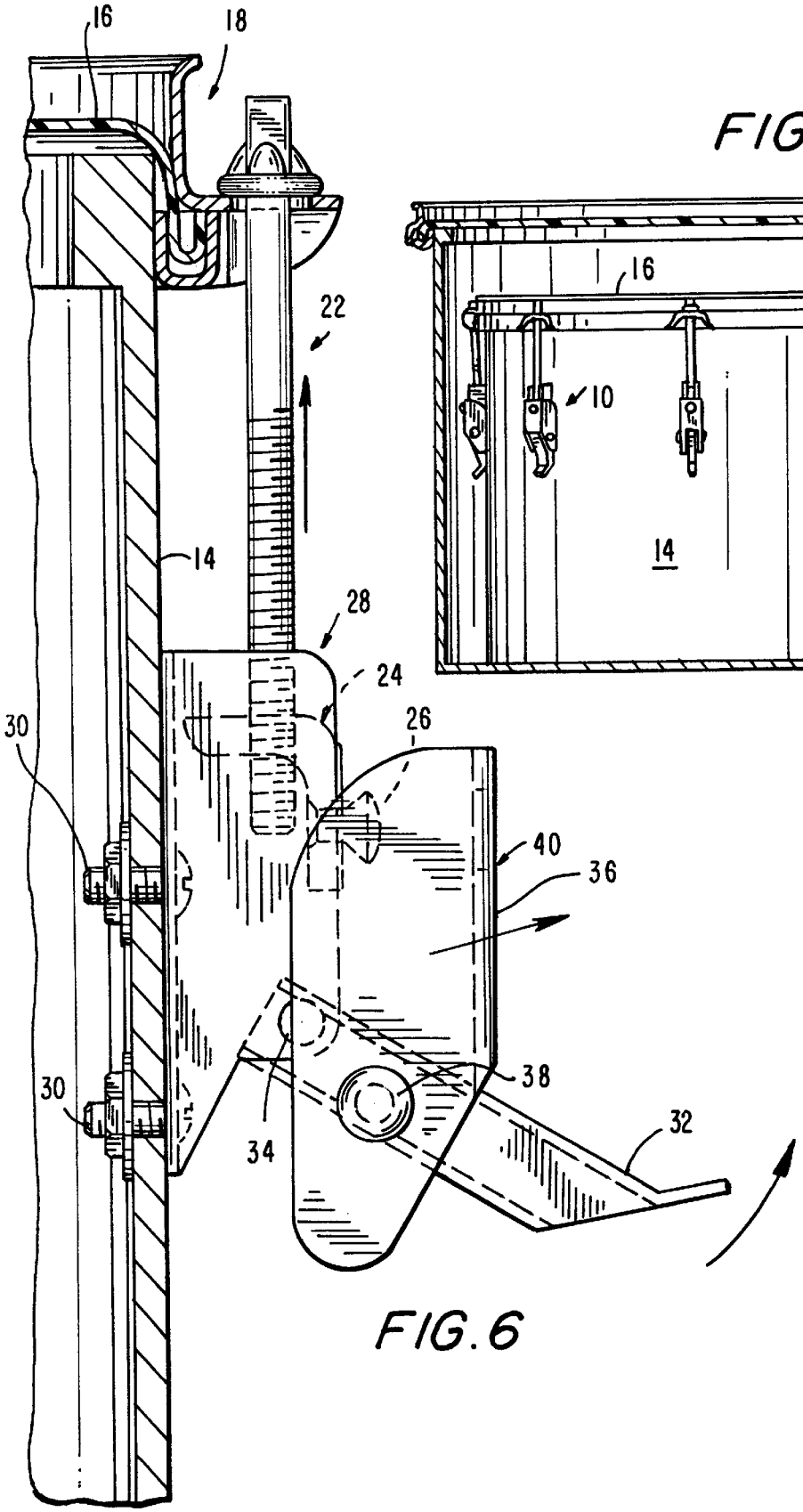
FIG. 6 is a sectional view showing the release latch assembly in an unlocked mode, with the arrows indicating the respective directional displacement between the locked and unlocked modes.

An operating lever 32 is pivotally attached to the bracket member 28 at a pin connection 34 as best shown in FIG. 6. The pin connection 34 functions as a fulcrum for the lever 32. A locking member 36 is attached at a pin connection 38 and travels with the operating lever 32. As will be noted in FIGS. 1 and 2, the locking member 36 is positionable, by displacement of the lever 32, adjacent to and in overlapping relationship with the bracket member 28. An aperture 40 in the locking member 36 is adapted for registration with the locking lug 26. Angular displacement of the lever 32 in the clockwise direction, to the locked position as shown in FIG. 5, will exert a downwardly directed linear force that is transmitted through the keeper member 24 and the bolt 22 to the drumhead 16. Referring now to FIG. 4 it will be seen that upon application of the linear force, an axis x-x of the externally threaded bolt 22 and an axis x-y of the internal threaded aperture in the keeper member 24 are angularly displaced and are not co-axial. A force component acting to displace the x-y axis exerts a stress on the threaded connection to resist inadvertent positional variation of the keeper member 24, as a result of vibration or similar factors. Note also that, the spacer segment 27 holds the bolt 22 in spaced relationship from the backwall 31 of the bracket member 28 to permit flawless engagement of the locking lug 26.

With regard to the operation of the release latch assembly 10, FIG. 6 illustrates, by arrows, the directional displacement of the several components. As the operating lever 32 is rotated counterclockwise the locking member 36 is moved away from the bracket member 26 so as to provide clearance for slidable removal and/or accommodation of the keeper member 24 and the bolt 22. It should be noted that removal of the bolt 22 does not require a change in the relative location of the keeper member 24 thus maintaining the drumhead tension setting.

When reinstalling the drumhead 16, the keeper member 24 is repositioned in the bracket member 28. The locking member 36 is rotated about the pin 38 for engaging the lock lug 26 within the aperture 40. It should be observed that after one keeper member 24 is registered with the bracket member 28 the other circumferentially positioned keeper members should also be aligned with respective bracket members. The surface finish and tolerance between the keeper member 24 and the bracket member 28 facilitate the docking procedure which may be accomplished through operator "touch" and "feel".

When the operating, lever 32 is displaced in a clockwise direction the locking member 36 is moved downwardly. As the operating lever 32 reaches its fully locked position as shown in FIG. 5, a linear force is exerted on the locking lug 26 and transmitted through the keeper member 24 and the bolt 22 to apply a tension to the drumhead 16.

Figure 7:
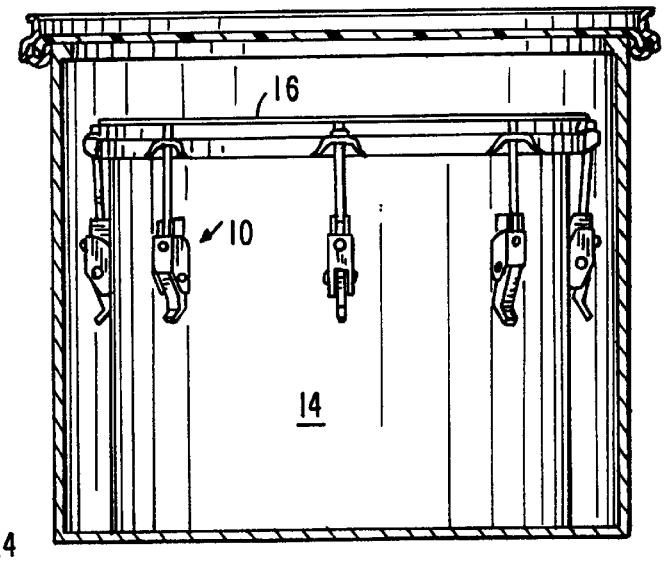
FIG. 7 is an elevational view illustrating a typical nestable drum storage arrangement utilizing the quick release latch assembly of this invention.

The relative position of the locking lug 26 on the bolt 22 can be adjusted by use of a drum key (not shown) to turn the bolt head 23 and vary the force to thereby fine tune the tension on the drumhead 16. The ability to rapidly remove and install the drumhead 16 without re-tuning makes nestable storage, as illustrated in FIG. 7, a viable and space-saving alternative.

It should thus be seen that there is provided a release latch assembly for a drumhead which serves to achieve the various preferred objects of this invention and which is well adapted to meet conditions of practical use.

Since various possible embodiments might be made of the present invention or modifications might be made to the exemplary embodiments set forth above, it is to be understood that all materials shown and described in the accompanying drawings are to be interpreted as illustrative and not restrictive, the scope of the invention being indicated by the appended claims rather than by the foregoing description, and all changes which come within the meaning and range of equivalency of the claims are therefore intended to be embraced therein.

Having thus described the invention there is claimed as new and desired to be secured by Letters Patent:

1. A quick release latch assembly for securement of a drumhead to a drumshell utilizing a rim for retaining the drumhead on the drumshell and tension bolts suspended from the rim for tuning the drumhead, comprising a keeper member adjustably positionable on an end portion of the tension bolt, said keeper member including a locking lug, a bracket member mounted to the drumshell for alignment with the tension bolt, said keeper member being adapted for accommodation within the bracket member, a pivotal lever attached to the bracket member, said lever including a locking member, said locking member being adapted for selective engagement with the locking lug for transmitting a force through the tension bolt upon rotation of the lever member in a first direction, said locking lug being disengageable from the locking member upon rotation of the lever member in a second direction with the tension bolt being removable from the bracket member for releasing the drumhead.

2. A quick release latch assembly as claimed in claim 1 wherein the relative position of the keeper member on the tension bolt is unchanged when the tension member is removed from the bracket member.

3. A quick release, latch assembly as claimed in claim 1 wherein the locking member transmits a nonaxially directed force component with respect to the tension bolt for exerting a stress on the connection between the keeper member and the tension bolt to resist inadvertent positional changes.

4. A quick release latch assembly as claimed in claim 1 wherein the magnitude of the force can be varied for tuning the drumhead by change in the relative location of the keeper member along the end portion of the tension member.

5. A quick release latch assembly as claimed in claim 1 wherein the confronting surfaces of the keeper member and the bracket member have a complementary configuration to facilitate slidable accommodation of the keeper member within the bracket member.

6. A quick release latch assembly as claimed in claim 1 wherein the keeper member includes a spacer segment for positioning the tension bolt in spaced relationship with respect to the bracket member.

7. A quick release latch assembly for drumhead securement to a drumshell with the drumhead being retained on the drumshell by a rim, comprising at least one tension member supported from said rim, a keeper member adjustably positionable on an end portion of said tension member for tuning the drumhead, said keeper member including a locking lug, a bracket member mounted to the drumshell in alignment with the tension member, said bracket member including an operating lever mechanically linked to a locking member, said keeper member being adapted for accommodation within the bracket member, said operating lever being displaceable to an open mode for positioning the locking member in engagement with the locking lug, said operating lever being displaceable to a locking mode for generating a force through the locking member, said force being transmitted to the drumhead with said tension bolt being removable from the bracket member without changing the relative location of the keeper member when the operating lever is displaced to the open mode.

8. A quick release latch assembly as claimed in claim 7 wherein the locking lug extends substantially perpendicular to the axis of the tension member.

9. A quick release latch assembly as claimed in claim 7 wherein the force applied by the locking member is nonaxial with respect to the tension member.

10. A quick release latch assembly as claimed in claim 7 wherein the tension member is a bolt and the end portion is externally threaded.

11. A quick release latch assembly as claimed in claim 7 wherein the locking member is pivotally connected to the operating lever.

* * * * *